US006769807B2

(12) United States Patent
Bayard

(10) Patent No.: US 6,769,807 B2
(45) Date of Patent: Aug. 3, 2004

(54) ARTICLE SHAPE MAINTENANCE SYSTEM

(76) Inventor: Madeline M. Bayard, 412 Sanders St., Baltimore, MD (US) 21230

( * ) Notice: Subject to any disclaimer, the term of this patent is extended or adjusted under 35 U.S.C. 154(b) by 0 days.

(21) Appl. No.: 10/270,884

(22) Filed: Oct. 11, 2002

(65) Prior Publication Data

US 2004/0069384 A1 Apr. 15, 2004

(51) Int. Cl.[7] ..... A45C 13/02

(52) U.S. Cl. ..... 383/127; 383/33; 150/106; 150/900; 190/106; 206/523

(58) Field of Search ..... 150/106, 900, 150/104, 113, 130, 100; 383/33, 4, 127; 190/106; 206/523

(56) References Cited

U.S. PATENT DOCUMENTS

| | | | | | |
|---|---|---|---|---|---|
| 1,927,471 | A | * | 9/1933 | Salomon | 190/1 |
| 2,270,598 | A | * | 1/1942 | Morgan | 297/188.06 |
| 2,618,790 | A | * | 11/1952 | Ritchey | 5/636 |
| 2,722,350 | A | | 11/1955 | Kleutgen | 223/75 |
| 3,041,643 | A | | 7/1962 | Struble | 12/128 |
| D221,498 | S | | 8/1971 | Goldberg | D86/10 |
| 3,938,569 | A | * | 2/1976 | Hill | 150/110 |
| 4,116,310 | A | * | 9/1978 | Shields | 224/576 |
| 4,185,673 | A | * | 1/1980 | Daniello | 383/14 |
| D258,699 | S | | 3/1981 | McPherson | D2/378.1 |
| 4,375,828 | A | * | 3/1983 | Biddison | 383/41 |
| 4,400,840 | A | | 8/1983 | Sly | 12/114.4 |
| 4,497,080 | A | | 2/1985 | Inspector | 12/128 |
| 4,846,340 | A | * | 7/1989 | Walther | 206/14 |
| 5,009,319 | A | | 4/1991 | Jantzen | 206/544 |
| 5,030,014 | A | * | 7/1991 | Diamond et al. | 383/127 |
| 5,138,728 | A | * | 8/1992 | Aston | 5/645 |
| 5,299,335 | A | * | 4/1994 | Ivester et al. | 5/641 |
| 5,446,936 | A | | 9/1995 | Barger | 12/128 |
| 5,458,164 | A | * | 10/1995 | Tawil | 141/10 |
| 5,918,332 | A | * | 7/1999 | Dees | 5/639 |
| 5,934,808 | A | * | 8/1999 | Ozeri et al. | 383/127 |
| 6,068,095 | A | | 5/2000 | Glembocki et al. | 190/127 |
| 6,430,764 | B1 | * | 8/2002 | Peters | 5/641 |
| 6,493,891 | B1 | * | 12/2002 | Livingston | 5/636 |

FOREIGN PATENT DOCUMENTS

| | | | |
|---|---|---|---|
| GB | 2184009 A | * | 6/1987 |
| KR | 2001017063 A | * | 3/2001 |

* cited by examiner

*Primary Examiner*—Sue A. Weaver

(57) ABSTRACT

An article shape maintenance system for maintaining the shape of a bag article during storage and non-use thereof. The article shape maintenance system includes a filler member, and a covering surrounding the filler member. The covering is comprised of a cloth material. The filler member is comprised of a resilient material such as foam rubber or polyester fiber. The filler member preferably includes a sachet containing a scented material. The filler member preferably includes silica gel or related material for absorbing moisture from within the bag.

18 Claims, 6 Drawing Sheets

ARTICLE SHAPE MAINTENANCE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to bag accessories and more specifically it relates to an article shape maintenance system for maintaining the shape of a bag article during storage and non-use thereof.

2. Description of the Related Art

Shape maintenance systems for bags that are to be stored or in non-use for extended periods of time have been in use for years. A typical system utilized to maintain the shape of bags is the usage of tissue paper forced into the interior of the bag. Tissue paper is messy and does not fill all areas of the bag. Another problem with tissue paper is that it may settle into a single location within the interior of the bag thereby exposing the remainder of the bag to be deformed.

Examples of patented devices which may be related to the present invention include U.S. Pat. No. 5,009,319 to Jantzen; U.S. Pat. No. 6,068,095 to Glembocki et al.; U.S. Pat. No. 4,400,840 to Sly; U.S. Pat. No. 2,722,350 to Kleutgen; U.S. Pat. No. 3,041,643 to Struble; U.S. Pat. No. 4,497,080 to Inspector; U.S. Pat. No. 5,446,936 to Barger; U.S. Pat. No. 221,498 to Goldberg; and U.S. Pat. No. 258,699 to McPherson.

While these devices may be suitable for the particular purpose to which they address, they are not as suitable for maintaining the shape of a bag article during storage and non-use thereof. Conventional articles, such as hand bags and shoulder bags, do not maintain their shape during storage or non-use thereof.

In these respects, the article shape maintenance system according to the present invention substantially departs from the conventional concepts and designs of the prior art, and in so doing provides an apparatus primarily developed for the purpose of maintaining the shape of a bag article during storage and non-use thereof.

BRIEF SUMMARY OF THE INVENTION

In view of the foregoing disadvantages inherent in the known types of bag inserts now present in the prior art, the present invention provides a new article shape maintenance system construction wherein the same can be utilized for maintaining the shape of a bag article during storage and non-use thereof.

The general purpose of the present invention, which will be described subsequently in greater detail, is to provide a new article shape maintenance system that has many of the advantages of the bag inserts mentioned heretofore and many novel features that result in a new article shape maintenance system which is not anticipated, rendered obvious, suggested, or even implied by any of the prior art bag inserts, either alone or in any combination thereof.

To attain this, the present invention generally comprises a filler member, and a covering surrounding the filler member.

The covering is comprised of a cloth material. The filler member is comprised of a resilient material such as foam rubber or polyester fiber. The filler member preferably includes a sachet containing a scented material. The filler member preferably includes silica gel or related material for absorbing moisture from within the bag.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an article shape maintenance system that will overcome the shortcomings of the prior art devices.

A second object is to provide an article shape maintenance system for maintaining the shape of a bag article during storage and non-use thereof.

Another object is to provide an article shape maintenance system that may be utilized within various types of bags such as but not limited to hand bags, shoulder bags, purses, book bags, gym bags and the like.

An additional object is to provide an article shape maintenance system that may be easily inserted and removed from within a bag.

A further object is to provide an article shape maintenance system that extends the appearance and useful life of an article.

Another object is to provide an article shape maintenance system that reduces damage to an article.

A further object is to provide an article shape maintenance system that reduces odors and mildew.

Another object is to provide an article shape maintenance system that is aesthetically pleasing.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
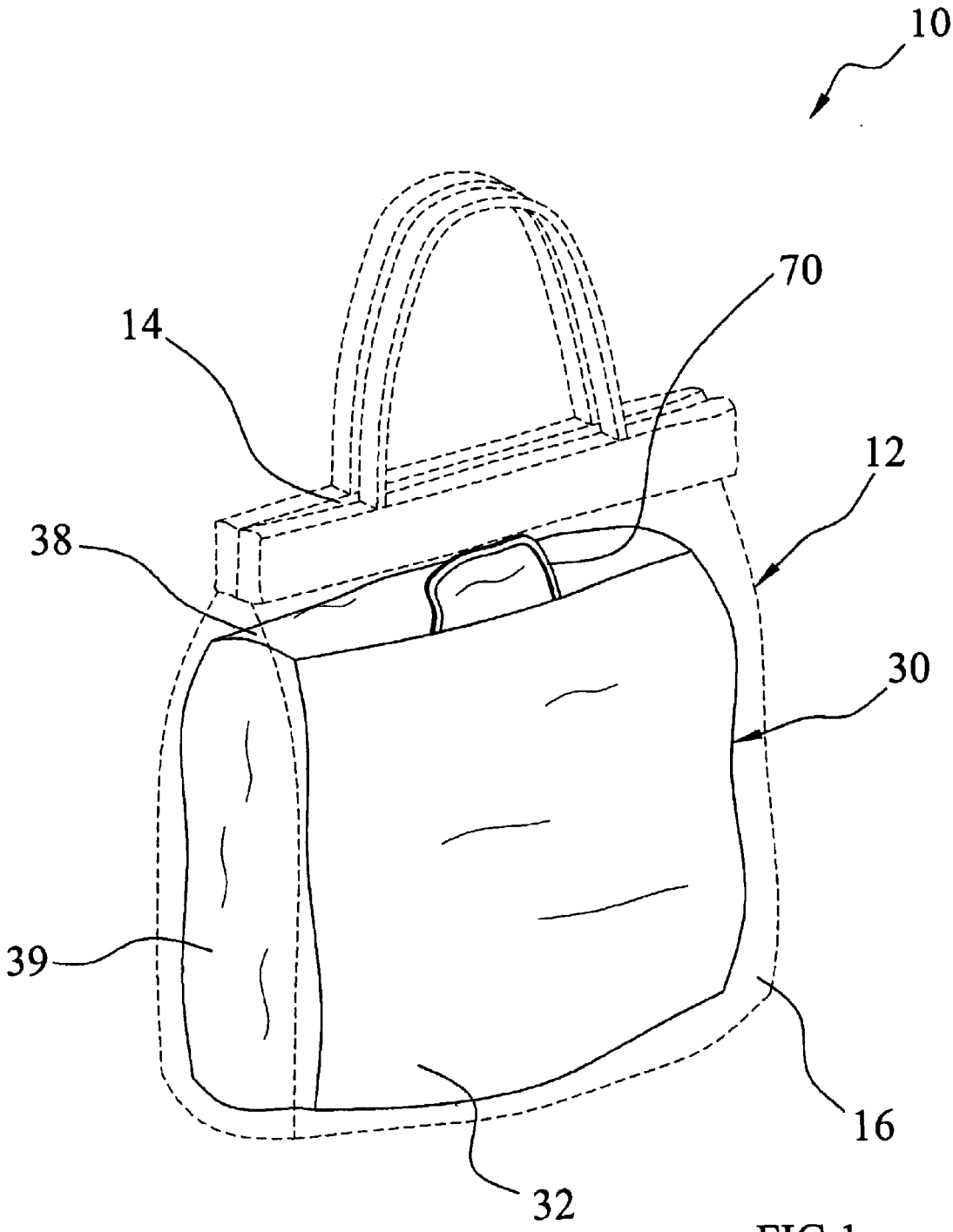
FIG. 1 is an upper perspective view of the present invention within a handbag.

Turning now descriptively to the drawings, in which similar reference characters denote similar elements throughout the several views, FIGS. 1 through 6 illustrate an article shape maintenance system 10, which comprises a filler member 40, and a covering 30 surrounding the filler member 40. The covering 30 is comprised of a cloth material. The filler member 40 is comprised of a resilient material such as foam rubber or polyester fiber. The filler member 40 preferably includes a sachet 50 containing a scented material. The filler member 40 preferably includes silica gel 60 or related material for absorbing moisture from within the bag 12.

Figure 2:
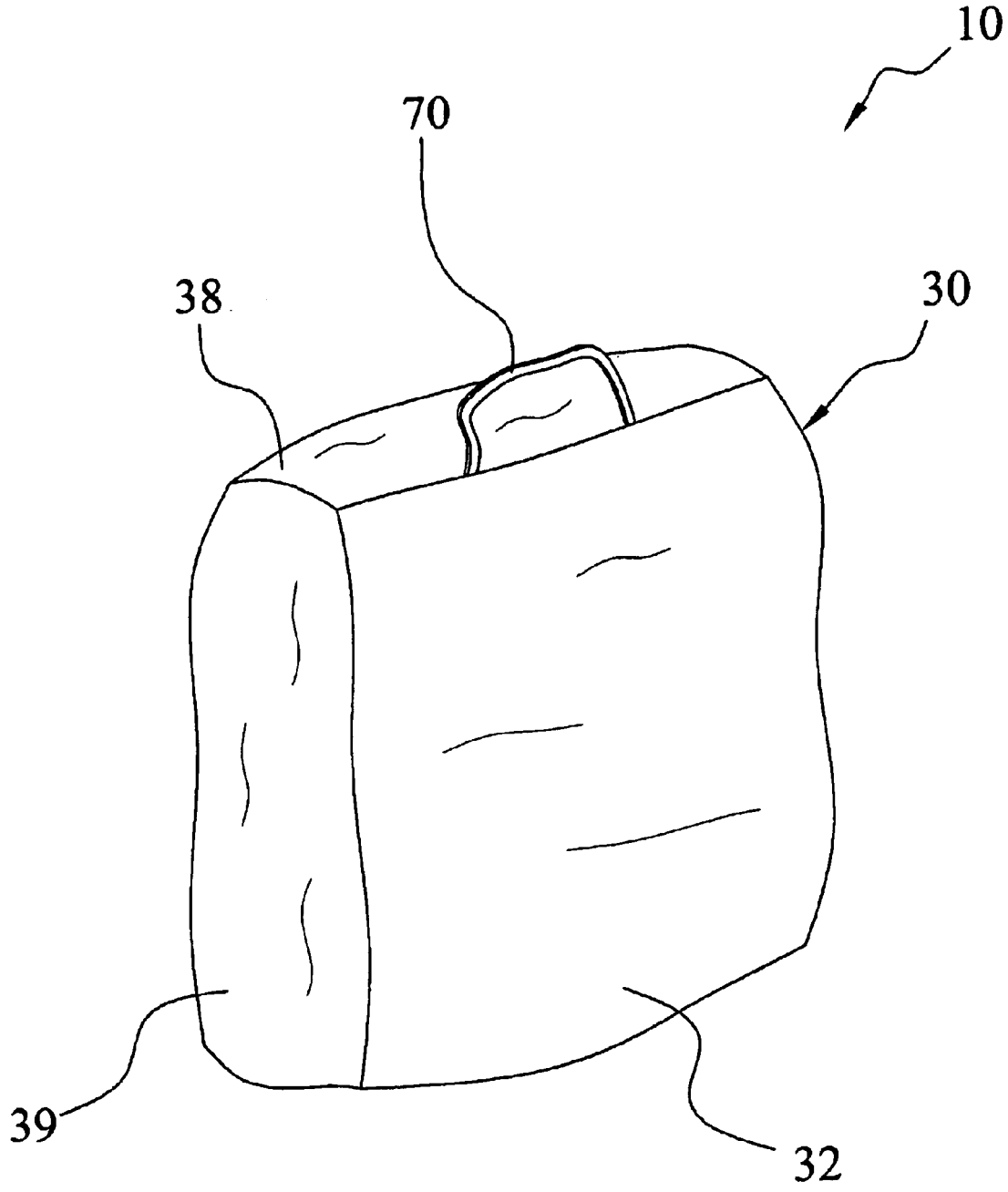
FIG. 2 is an upper perspective view of the present invention.
Figure 3:
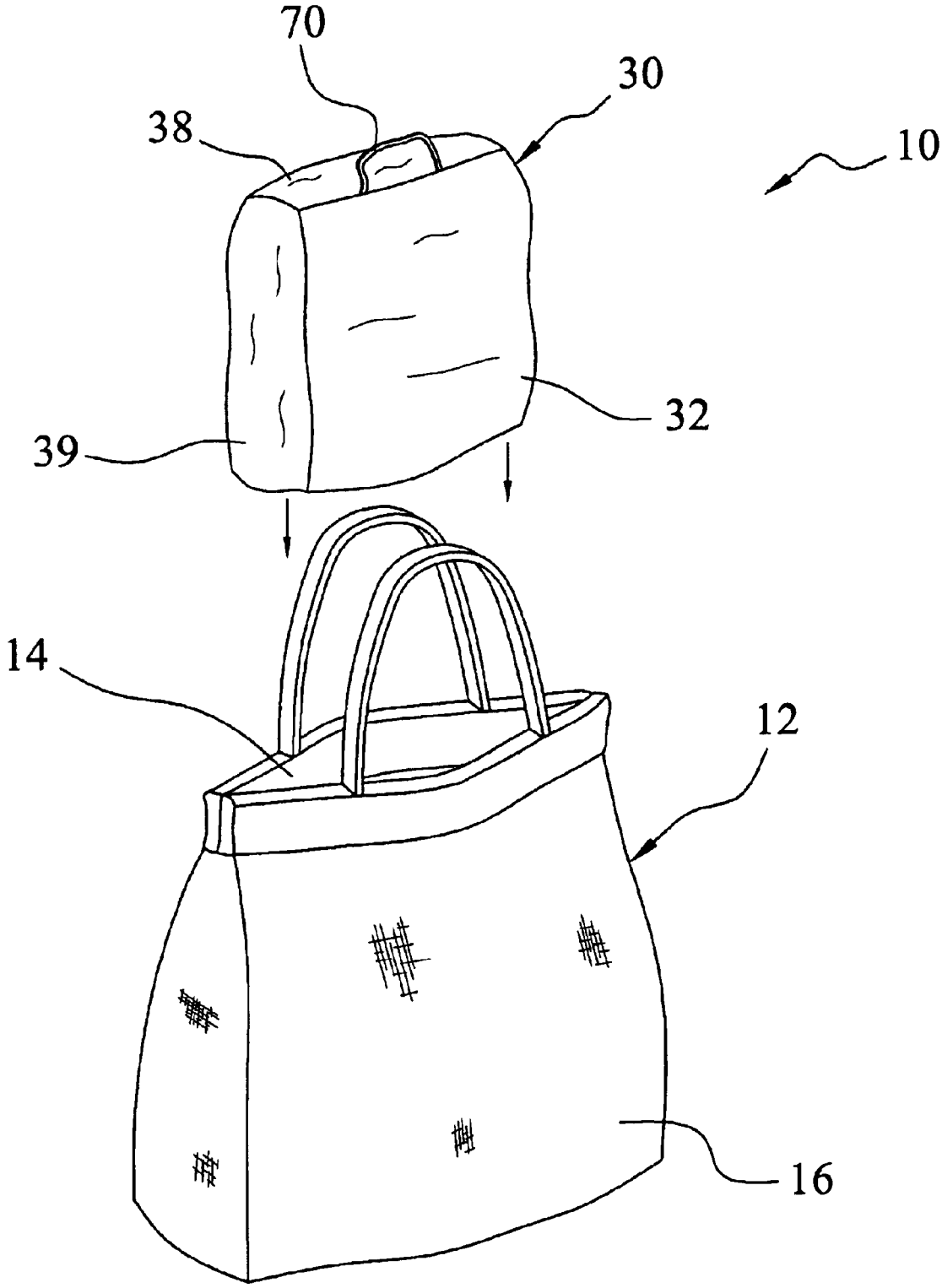
FIG. 3 is an exploded upper perspective view of the present invention being inserted into a handbag.

As shown in FIGS. 1 through 3 of the drawings, the article shape maintenance system 10 preferably has a rectangular shape, though various other shapes may be utilized for accommodating various structures of bags 12. A filler member 40 is provided having the desired shape of the article shape maintenance system 10. The filler member 40 is comprised of a soft and resilient material such as but not limited to foam rubber, fiber or polyester fiber. The filler member 40 is preferably permeable for allowing air to enter and exit through thereof.

Figure 5:
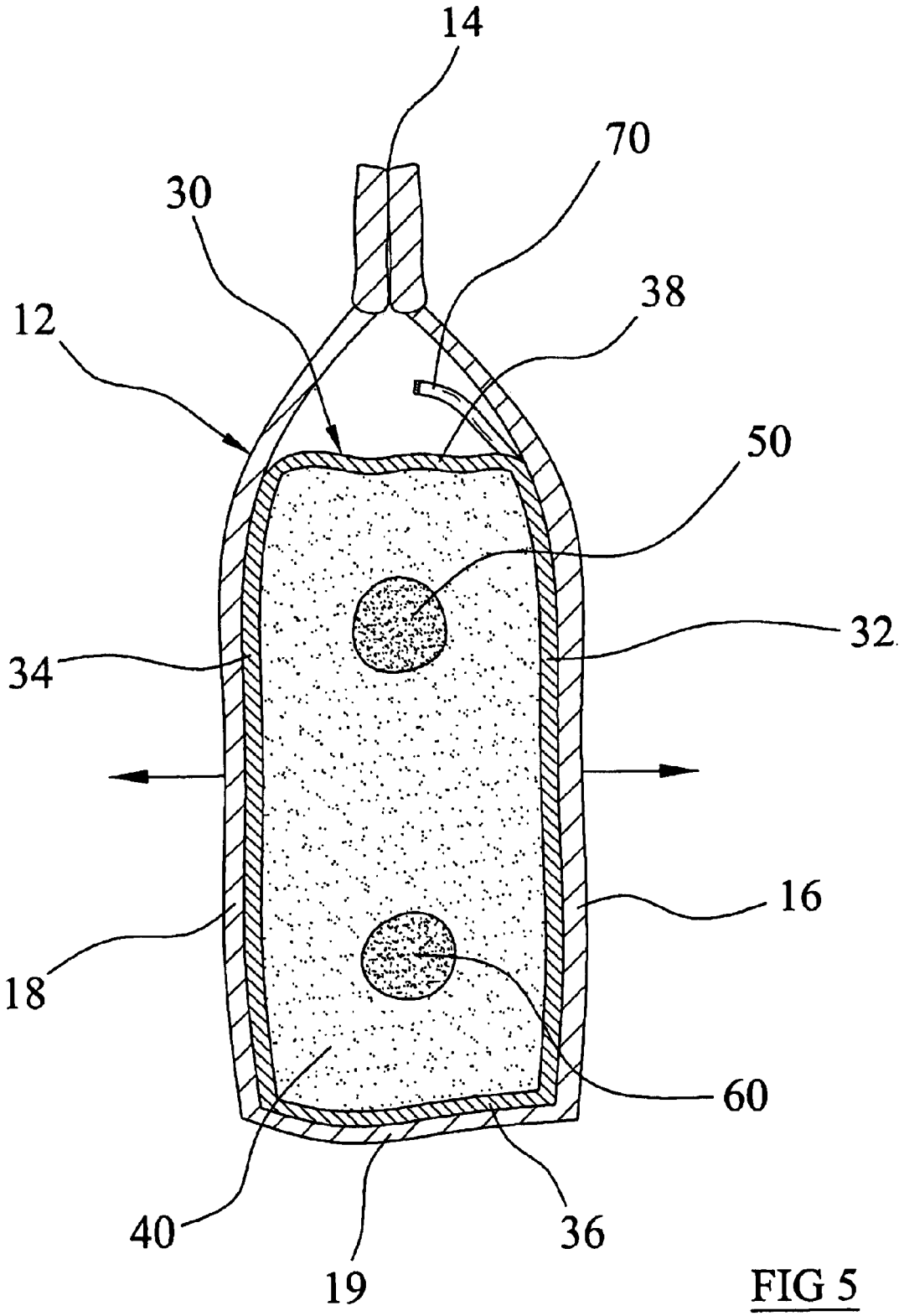
FIG. 5 is a side cutaway view of the present invention within a handbag.

A sachet 50 filled with scented material is preferably positioned within the filler member 40 as shown in FIG. 5 of the drawings. The scented material within the sachet 50 may be comprised of various well known scented materials that provide a scent for extended periods of time. The scented material may be positioned throughout the filler member 40 instead of within a sachet 50.

Silica gel 60 or related moisture absorbing material is preferably positioned within the filler member 40 for absorbing moisture as shown in FIG. 5 of the drawings. The silica gel 60 may be positioned throughout the filler member 40 or within a permeable container within the filler member 40.

The covering 30 preferably completely surrounds the filler member 40. The covering 30 is preferably comprised of a permeable material such as but not limited cloth. The covering 30 is preferably comprised of a soft and flexible material. The permeability of the covering 30 allows for the sachet 50 to disperse the scent within the interior of the bag 12 and allows the silica gel 60 to absorb moisture within the bag 12. The covering 30 has a first side wall 32, a second side wall 34, a bottom wall 36, a first end wall 37, a second end wall 39 and a top wall 38 forming a rectangular structure surrounding the filler member 40.

Figure 6:
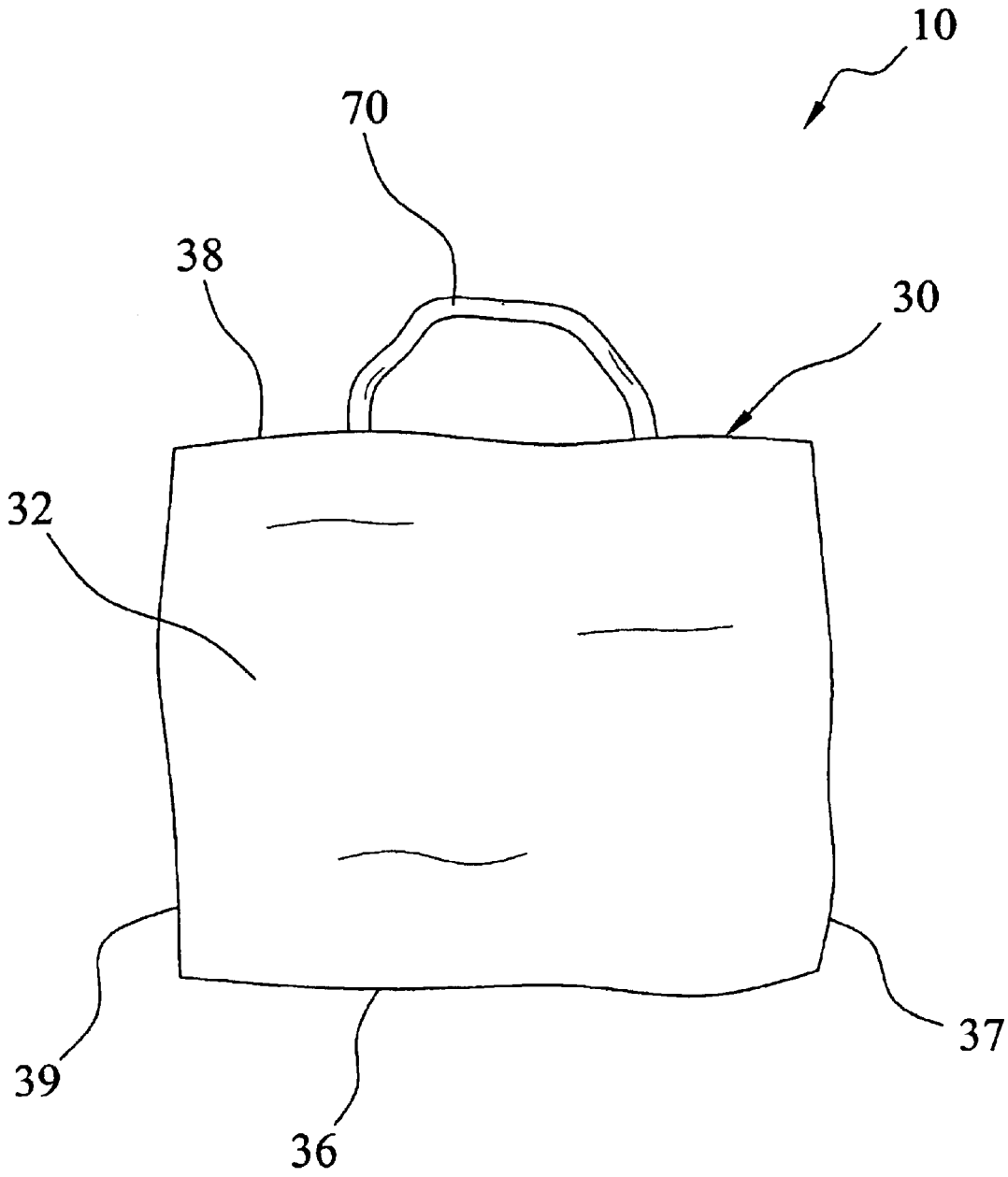
FIG. 6 is a side view of the present invention.

FIGS. 1 through 6 illustrate the attachment of at least one handle member 70 to the covering 30. The handle member 70 is preferably comprised of a looped structure as best illustrated in FIG. 6 of the drawings. The handle member 70 is preferably attached to the top wall 38, but may be attached to various portions of the covering 30. The handle member 70 is preferably attached towards one side of the top wall 38 as further shown in FIG. 2 of the drawings. The handle member 70 is utilized for removing and inserting the present invention with a bag 12.

Figure 4:
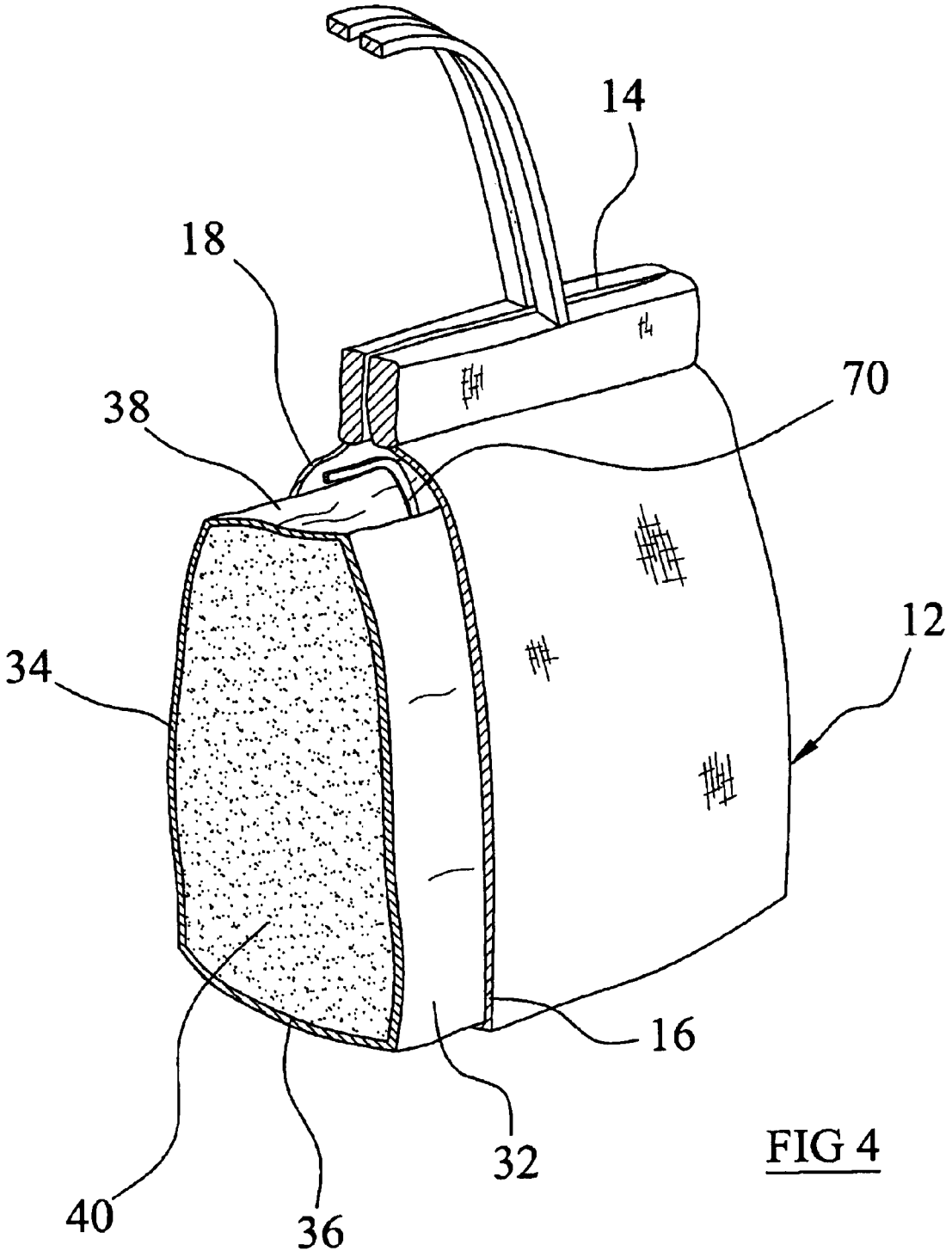
FIG. 4 is a cutaway upper perspective view of the present invention within a handbag.

In use, the user opens the opening 14 of the bag 12 as shown in FIG. 3 of the drawings. The user then inserts the article shape maintenance system 10 into the interior of the bag 12 through the opening 14 as shown in FIG. 1 of the drawings. The opening 14 of the bag 12 is then preferably closed as illustrated in FIGS. 1, 4, and 5 of the drawings. The first side wall 32 of the covering 30 is adjacent to the first wall 16 of the bag 12 as shown in FIG. 5 of the drawings. The second side wall 34 of the covering 30 is adjacent to the second wall 18 of the bag 12 as shown in FIG. 5 of the drawings. The bottom wall 36 of the covering 30 is adjacent to the floor 19 of the bag 12 as shown in FIG. 5 of the drawings. The filler member 40 and the covering 30 prevent the bag 12 from becoming deformed during extended periods of storage and non-usage. The sachet 50 provides a pleasant scent within the interior of the bag 12 while the silica gel 60 reduces moisture thereby preventing mildew. When the user desires to utilize the bag 12, the article shape maintenance system 10 is simply removed from the bag 12 through the opening 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index Elements for Article Shape Maintenance System

ENVIRONMENTAL ELEMENTS

10. Article Shape Maintenance System
11.
12. Bag
13.
14. Opening
15.
16. First Wall
17.
18. Second Wall
19. Floor
20.
21.
22.
23.
24.
25.
26.
27.
28.
29.
30. Covering
31.
32. First Side Wall
33.
34. Second Side Wall
35.
36. Bottom Wall -continued

| Index Elements for Article Shape Maintenance System |
|---|
| ENVIRONMENTAL ELEMENTS |
| 37. First End Wall |
| 38. Top Wall |
| 39. Second End Wall |
| 40. Filler Member |
| 41. |
| 42. |
| 43. |
| 44. |
| 45. |
| 46. |
| 47. |
| 48. |
| 49. |
| 50. Sachet |
| 51. |
| 52. |
| 53. |
| 54. |
| 55. |
| 56. |
| 57. |
| 58. |
| 59. |
| 60. Silica Gel |
| 61. |
| 62. |
| 63. |
| 64. |
| 65. |
| 66. |
| 67. |
| 68. |
| 69. |
| 70. Handle Member |
| 71. |
| 72. |
| 73. |
| 74. |
| 75. |
| 76. |
| 77. |
| 78. |
| 79. |

I claim:

1. An article shape maintenance system for maintaining the shape of a bag, comprising:

a filler member, wherein said filler member is comprised of a resilient material;

a volume of moisture absorbing material within said filler member; and a covering surrounding said filler member, wherein said covering is comprised of a permeable material.

2. The article shape maintenance system of claim 1, wherein said covering has a first side wall, a second side wall opposite of said first side wall, a bottom wall between said first side wall and said second side wall, a top wall between said first side wall and said second side wall opposite of said bottom wall, a first end wall enclosing a first end of said covering, and a second end wall enclosing a second end of said covering.

3. The article shape maintenance system of claim 1, wherein said covering is comprised of a cloth material.

4. The article shape maintenance system of claim 1, wherein said filler member is comprised of a foam rubber material.

5. The article shape maintenance system of claim 1, wherein said filler member is comprised of a polyester fiber material.

6. The article shape maintenance system of claim 1, including a sachet filled with scented material within said filler member.

7. The article shape maintenance system of claim 1, wherein said filler member included scented material.

8. The article shape maintenance system of claim 1, wherein said volume of moisture absorbing material is comprised of silica gel.

9. An article shape maintenance system for maintaining the shape of a bag, comprising:

a filler member, wherein said filler member is comprised of a resilient material;

a volume of moisture absorbing material within said filler member;

a covering surrounding said filler member, wherein said covering is comprised of a permeable material; and a handle member attached to said covering.

10. The article shape maintenance system of claim 9, wherein said covering has a first side wall, a second side wall opposite of said first side wall, a bottom wall between said first side wall and said second side wall, a top wall between said first side wall and said second side wall opposite of said bottom wall, a first end wall enclosing a first end of said covering, and a second end wall enclosing a second end of said covering.

11. The article shape maintenance system of claim 9, wherein said covering is comprised of a cloth material.

12. The article shape maintenance system of claim 9, wherein said filler member is comprised of a foam rubber material.

13. The article shape maintenance system of claim 9, wherein said filler member is comprised of a polyester fiber material.

14. The article shape maintenance system of claim 9, including a sachet filled with scented material within said filler member.

15. The article shape maintenance system of claim 9, wherein said filler member included scented material.

16. The article shape maintenance system of claim 9, wherein said volume of moisture absorbing material is comprised of silica gel.

17. The article shape maintenance system of claim 9, wherein said volume of moisture absorbing material is contained within permeable container.

18. A method of utilizing an article shape maintenance device within a bag for maintaining a desired shape of said bag, said article shape maintenance device having a filler member having a rectangular structure, wherein said filler member is comprised of a resilient material, and a covering surrounding said filler member, wherein said covering is comprised of a permeable material, wherein said covering has a first side wall, a second side wall opposite of said first side wall, a bottom wall between said first side wall and said second side wall, a top wall between said first side wall and said second side wall opposite of said bottom wall, a first end wall enclosing a first end of said covering, and a second end wall enclosing a second end of said covering, wherein said covering is comprised of a cloth material, a sachet filled with scented material within said filler member, and a volume of silica gel within said filler member, said method comprising the steps of:

(a) expanding an opening of said bag;

(b) inserting said article shape maintenance device within an interior of said bag through said opening; and (c) closing said opening of said bag.

* * * * *